US008162506B2

(12) United States Patent
Wei et al.

(10) Patent No.: US 8,162,506 B2
(45) Date of Patent: Apr. 24, 2012

(54) ILLUMINATING APPARATUS WITH PHOSPHOR FILMS

(75) Inventors: An-Chi Wei, Miao-Li Hsien (TW); Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 266 days.

(21) Appl. No.: 12/582,807

(22) Filed: Oct. 21, 2009

(65) Prior Publication Data

US 2010/0157572 A1 Jun. 24, 2010

(30) Foreign Application Priority Data

Dec. 18, 2008 (CN) ..... 2008 1 0306351

(51) Int. Cl.
*F21V 9/16* (2006.01)

(52) U.S. Cl. ..... 362/231; 362/84; 362/800; 257/98

(58) Field of Classification Search ..... 362/231, 362/84, 249.02, 330, 800; 313/506; 257/98
See application file for complete search history.

(56) References Cited

U.S. PATENT DOCUMENTS

| | | | | |
|---|---|---|---|---|
| 7,182,481 | B2 * | 2/2007 | Shimura | 362/244 |
| 7,182,627 | B1 * | 2/2007 | Huang | 439/487 |
| 7,549,786 | B2 * | 6/2009 | Higley et al. | 362/646 |
| 7,819,539 | B2 * | 10/2010 | Kim et al. | 362/84 |
| 7,838,896 | B2 * | 11/2010 | Su et al. | 257/98 |
| 7,855,395 | B2 * | 12/2010 | Lee et al. | 257/99 |
| 7,915,627 | B2 * | 3/2011 | Li | 257/98 |
| 2009/0147497 | A1 * | 6/2009 | Nada | 362/84 |
| 2009/0279311 | A1 * | 11/2009 | Yu et al. | 362/310 |
| 2011/0068356 | A1 * | 3/2011 | Chiang et al. | 257/98 |

FOREIGN PATENT DOCUMENTS

| | | | |
|---|---|---|---|
| CN | 1218996 | A | 6/1999 |
| CN | 1094657 | C | 11/2002 |
| CN | 101081980 | A | 12/2007 |

* cited by examiner

*Primary Examiner* — Peggy A. Neils
(74) *Attorney, Agent, or Firm* — Altis Law Group, Inc.

(57) ABSTRACT

An exemplary illuminating apparatus includes a light source, a supporting member, a first film and a second film. The light source includes a substrate and a plurality of light emitting diode arranged on the substrate. The supporting member connected to the substrate. The supporting member includes a light emitting surface at a side thereof distant from the light emitting diodes. The first film and the second film attached to each other and arranged at the light emitting surface of the supporting member. The first film includes a first phosphor doped therein, and the second film includes a second phosphor doped therein. Each of the first phosphor and the second phosphor is capable of being excited by light emitted from the light-emitting diodes and converting a wavelength of the light into a desired wavelength.

18 Claims, 4 Drawing Sheets

ILLUMINATING APPARATUS WITH PHOSPHOR FILMS

BACKGROUND

1. Technical Field

The present disclosure generally relates to illuminating apparatuses, and particularly to an illuminating apparatus with a light emitting diode and phosphor films for emitting different colors of light.

2. Discussion of Related Art

Light emitting diodes (LEDs) are one kind of semiconductor element. Nowadays, LEDs are extensively used as light sources for illuminating apparatuses, due to their high luminous efficiency, low power consumption and long work life.

In some LED devices, to satisfy certain illuminating requirements, light mixing is employed. That is, light with different colors or wavelengths is emitted from different light emitting diodes, and such light is mixed to form light of a desired color or wavelength. For example, white light is obtained by mixing light emitted by red, green, and blue LED dies. However, because these three LED dies cannot occupy the same position in the LED device and must be arranged adjacent to each other, the light mixing is not necessarily thorough, and the light output from the LED device may be non-uniform. Alternatively, a light source module may use a blue LED as a primary light source to produce a final emission of white light. The blue light emitted from the blue LED strikes phosphor material of the light source module to generate secondary yellow color light. The combination of the yellow light and residual (unconverted) blue light produces white light. However, the phosphor is usually packaged within the blue LED itself. It is difficult to ensure that the phosphor is evenly distributed in the LED. If the phosphor is unevenly distributed, the light output from the light source module may be non-uniform.

Therefore, what is needed is an illuminating apparatus to overcome the above described shortcomings.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION OF EMBODIMENTS

Reference will now be made to the drawings to describe various embodiments of the present illuminating apparatus in detail.

Figure 1:
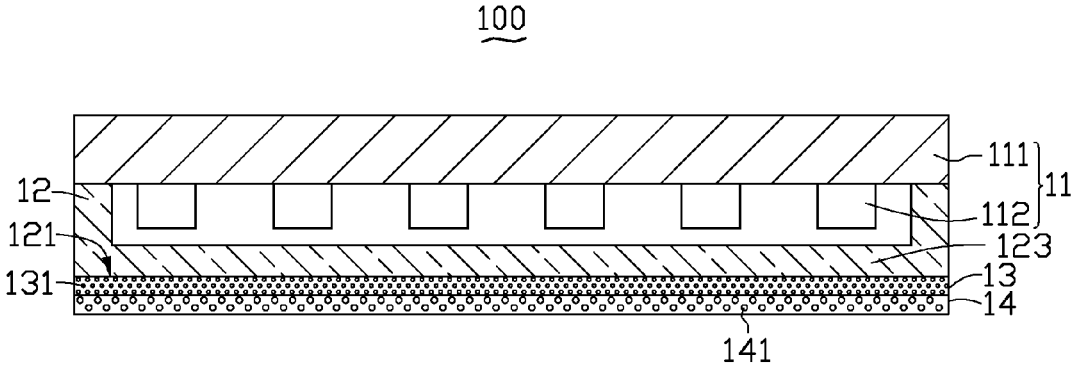
FIG. 1 is a cross-sectional view of an illuminating apparatus, according to a first exemplary embodiment.

Referring to FIG. 1, an illuminating apparatus 100, in accordance with a first exemplary embodiment, includes a light source 11, a supporting member 12, a first film 13, and a second film 14.

The light source 11 includes a substrate 111, and a plurality of light emitting diodes (LEDs) 112 arranged on an inner side of the substrate 111. In the present embodiment, the LEDs 112 are ultraviolet LEDs.

In this embodiment, the supporting member 12 has a generally U-shaped cross section. A main, central portion of the supporting member 12 is in the form of, or includes, an optical lens 123. The optical lens 123 is plate-shaped and parallel to the substrate 111, and has a flat surface 121. The supporting member 12 is arranged on the inner side of the substrate 111 and engaged with a periphery of an underside of the substrate 111. Thereby, the substrate 111 and the supporting member 12 cooperatively define a cavity therebetween. The LEDs 112 are located in the cavity. Light emitted from the LEDs 112 transmits through the optical lens 123 and emits from the optical lens 123 through the flat surface 121.

The first film 13 is attached on the flat surface 121 of the optical lens 123, and is doped with a first phosphor 131. In the present embodiment, the first film 13 is a planar film.

The second film 14 is attached to an outer side of the first film 13, and is doped with a second phosphor 141. In the present embodiment, the second film 14 is a planar film. The first film 13 or the second film 14 having thickness at least more than 100 micron (um). In an alternative embodiment, the second film 14 can be attached to an inner side of the first film 13.

The first film 13 and the second film 14 may be made of silicone, polymethyl methacrylate (PMMA), resin, plastic, polyethylene terephthalate (PET), or polycarbonate (PC).

In the present embodiment, each of the first phosphor 131 and the second phosphor 141 is in the form of a multiplicity of particles. Sizes of the particles can be in the range from 20 nanometers (nm) to 40 um. The first phosphor 131 and the second phosphor 141 may be made of sulfides, aluminates, oxides, silicates, or nitrides. For example, the first phosphor 131 and the second phosphor 141 can be selected from $Ca_2Al_{12}O_{19}$:Mn, (Ca,Sr,Ba)$Al_2O_4$:Eu, CdS, $Ca_2Si_5N_8$:$Eu^{2+}$, $Y_3A_{15}O12Ce^{3+}$(YAG), $Tb_3Al_5O_{12}$:$Ce^{3+}$(YAG), CdTe, (Mg,Ca,Sr,Ba)$_2SiO_4$:$Eu^{2+}$, (Ca,Mg,Y)SiwAl$_x$O$_y$,N$_z$:$Eu^{2+}$, $Y_2O_2S$:$Eu^{3+}$, (Mg,Ca,Sr,Ba)$_3Si_2O_7$:$Eu^{2+}$, (Ca,Sr,Ba)S:$Eu^{2+}$, $Ca_8Mg(SiO_4)_4Cl_2$:$Eu^{2+}$, $BaMgAl_{10}O_{17}$:$Eu^{2+}$($Mn^{2+}$), (Sr,Ca,Ba)$Si_xO_yN_z$:$Eu^{2+}$, and/or CdSe.

The first phosphor 131 and the second phosphor 141 are excited by the light emitted from the LEDs 112, and convert the wavelength of such light. In the present embodiment, part of a first color light emitted from the LEDs 112 strikes the first phosphor 13 of the first film 13 to generate a second color light. Part of the second color light strikes the second phosphor 141 of the second film 14 to generate a third color light. Part of the first color light emitted from the LEDs 112 strikes the second phosphor 141 of the second film 14 to generate a fourth color light. Finally, the combination of the unconverted first color light, the second color light, the third color light, and the fourth color light produces light of a desired color or colors. In one example, the unconverted first color light, the second color light, the third color light, and the fourth color light mix and produce mixed light of a single desired color. Different densities of phosphor can absorb different proportions of light emitted from the light source 11, and thus emit light with different colors. Therefore, the density of the first and second phosphors 131, 141 can be varied in the first and second films 13, 14 to achieve light of any of numerous different desired colors.

It will be understood that in alternative embodiments, the illuminating apparatus 100 can include more than two films stacked one on the other. In addition, the surface 121 of the optical lens 123, surfaces of the first film 13, and surfaces of the second film 14 need not necessarily be flat. In alternative embodiments, any one or more of such surfaces can for example be arc-shaped or wavy cross section.

In a conventional illuminating apparatus, phosphor is packaged in an LED, and it is difficult to ensure that the phosphor is evenly distributed in the LED. In the present embodiment, there is no need to package the first or second phosphors 131, 141 in the LEDs 112. Instead, the first and second phosphors 131, 141 can be substantially evenly distributed in the first and second films 13, 14, respectively. Thus manufacturing of the illuminating apparatus 100 can be simplified and cost-effective. Furthermore, if it is desired to the make the illuminating apparatus 100 have different light emission characteristics (e.g. emission of different colored light), there is no need to change the LEDs 112. Only selected of the first and second phosphors 131, 141 of the first and second films 13, 14 need be changed. Therefore the illuminating apparatus 100 has good versatility in manufacturing.

Figure 2:
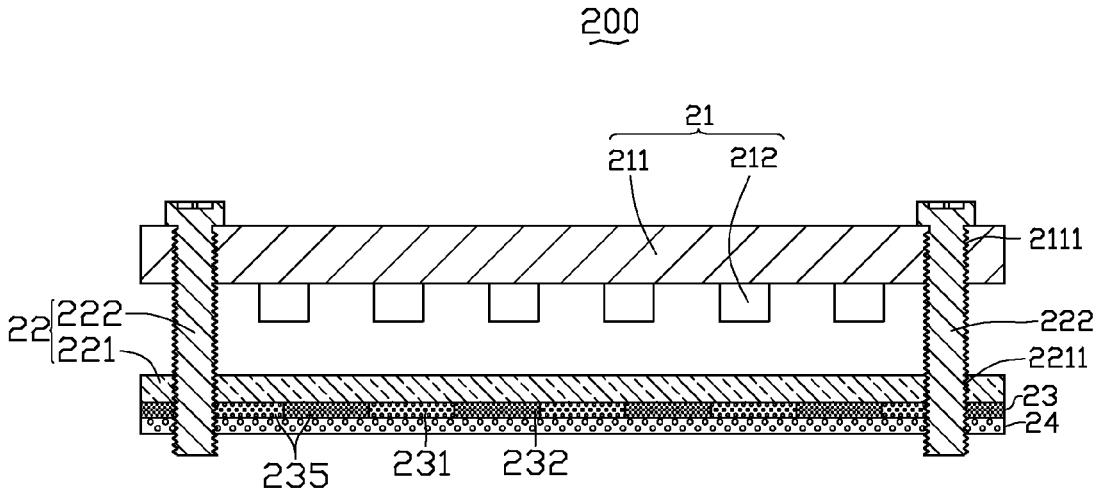
FIG. 2 is a cross-sectional view of an illuminating apparatus, according to a second exemplary embodiment.

Referring to FIG. 2, an illuminating apparatus 200, in accordance with a second exemplary embodiment, includes a light source 21, a supporting member 22, a first film 23, and a second film 24. The illuminating apparatus 200 is distinguished from the illuminating apparatus 100 in that two screws 222 are also provided, the supporting member 22 includes a flat optical lens 221, and the first film 23 further defines a plurality of regions 235.

In the present embodiment, the light source 21 includes a substrate 211 having two first holes 2111, and a plurality of LEDs 212 arranged on an inner side of the substrate 211. The first holes 2111 have screw threads, and can be through holes or blind holes. In the present embodiment, the first holes 2111 are through holes. The optical lens 221 has two threaded through holes 2211. The optical lens 221 can be locked in position opposite to emitting surfaces of the LEDs 212 by threaded engagement of the two screws 222 in the first holes 2111 and the through holes 2211.

The first film 23 is attached on an outer side of the optical lens 221. The regions 235 are doped with different kinds of phosphors. The different kinds of phosphors can be individually doped into different regions 235, respectively. Alternatively, the different kinds of phosphors can be intermixed with each other to produce desired combinations of phosphors, and then the various combinations of phosphors can be individually doped into different regions 235, respectively. In the present embodiment, the regions 235 have the same size and shape, and are evenly distributed in the first film 23. First and second phosphors 231, 232 are alternately doped in the regions 235. That is, for example, the first phosphor 231 is doped into every odd-numbered region 235 in a sequence of the first regions 235, and the second phosphor 232 is doped into every even-numbered region 235 in the sequence. In a further refinement of this example, the first regions 235 are arranged in the form of an m×n array, i.e., a matrix. In contrast, the second film 24 is doped in a similar manner as that of the second film 14 of the first embodiment.

The illuminating apparatus 200 has advantages similar to those of the illuminating apparatus 100. There is no need to package the first and second phosphors 231, 232 in the light source 21. Manufacturing of the illuminating apparatus 200 can be simplified and cost-effective. In addition, the illuminating apparatus 200 has good versatility in manufacturing.

It will be understood that in alternative embodiments, the positions of the first film 23 and the second film 24 can be exchanged. In other alternative embodiments, there can be more that two first holes 2111, through holes 2211 and screws 222.

Figure 3:
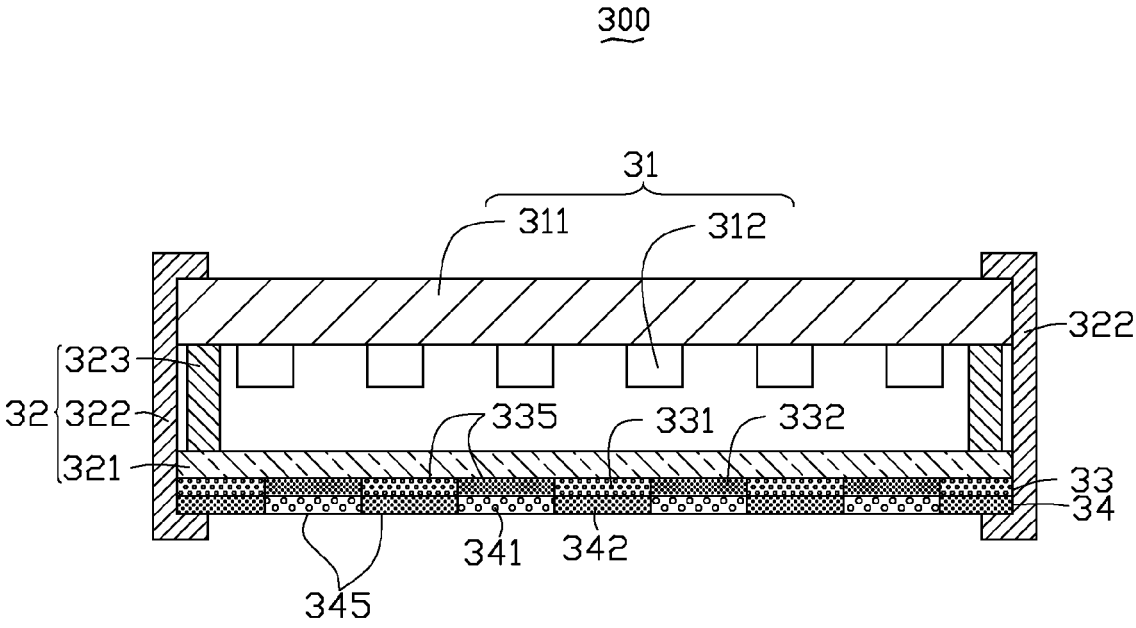
FIG. 3 is a cross-sectional view of an illuminating apparatus, according to a third exemplary embodiment, showing an arrangement of first regions of a first film and second regions of a second film.

Referring to FIG. 3, an illuminating apparatus 300, in accordance with a third exemplary embodiment, includes a light source 31, a supporting member 32, a first film 33 and a second film 34. The illuminating apparatus 300 has a configuration similar to that of the illuminating apparatus 200. The illuminating apparatus 300 is distinguished from the illuminating apparatus 200 in that two latch portions 322 and two holding members 323 are also provided, the supporting member 32 includes a flat optical lens 321, and the second film 34 further defines a plurality of second regions 345.

In the present embodiment, a cross-section of each of the holding members 323 is rectangular. The holding members 323 are arranged on a periphery of an inner side of a substrate 311 of the light source 31, and are configured for holding the optical lens 321 in position a predetermined distance away from LEDs 312 of the light source 31. A cross-section of each of the latch portions 322 is generally U-shaped. The latch portions 322 are hitched onto peripheral portions of outer sides of the substrate 311 and the second film 34, and thereby secure the optical lens 321 on the holding members 323.

The second regions 345 of the second film 34 are doped with different kinds of phosphors. The different kinds of phosphors can be individually doped into different second regions 345, respectively. Alternatively, the different kinds of phosphors can be intermixed with each other to produce desired combinations of phosphors, and then the various combinations of phosphors can be individually doped into different second regions 345, respectively. In the present embodiment, the second regions 345 have the same size and shape, and are evenly distributed in the second film 34.

First regions 335 of the first film 33 and the second regions 345 of the second film 34 have the same size and shape. The first regions 335 of the first film 33 are respectively directly opposite to the second regions 345 of the second film 34. First and third phosphors 331, 332 are alternately doped in the first regions 335. That is, for example, the first phosphor 331 is doped into every odd-numbered first region 335 in a sequence of the first regions 335, and the third phosphor 332 is doped into every even-numbered first region 335 in the sequence. Second and fourth phosphors 341, 342 are alternately doped in the second regions 345. That is, for example, the second phosphor 341 is doped into every odd-numbered second region 345 in a sequence of the second regions 345, and the fourth phosphor 342 is doped into every even-numbered second region 345 in the sequence. The first phosphor 331, the third phosphor 332, the second phosphor 341, and the fourth phosphor 342 are excited by the light emitted from the light source 31 and convert the wavelength of such light. Therefore, the illuminating apparatus 300 can emit light with different desired colors.

Figure 4:
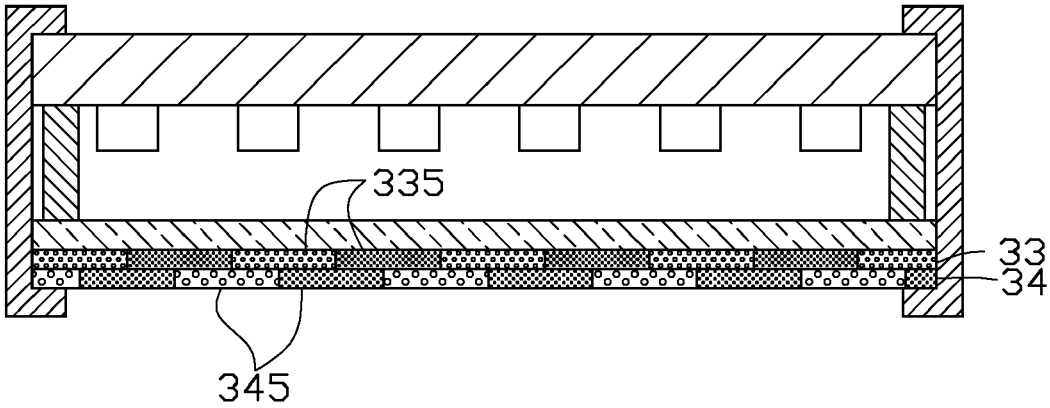
FIG. 4 is similar to FIG. 3, but showing a variation of the third exemplary embodiment, in which the first regions of the first film and the second regions of the second film have a different arrangement.

Referring to FIG. 4, in a variation of the third exemplary embodiment, the first regions 335 of the first film 33 can be staggered relative to the second regions 345 of the second film 34. In the illustrated embodiment, each first region 335 is positioned to correspond to approximately half of each of two adjacent second regions 345.

The illuminating apparatus 300 has advantages similar to those of the illuminating apparatus 100. There is no need to package the first, second, third and fourth phosphors 331, 341, 332, 342 in the light source 31. Manufacturing of the illuminating apparatus 300 can be simplified and cost-effective. In addition, the illuminating apparatus 300 has good versatility in manufacturing.

It will be understood that in alternative embodiments, the holding members 323 and the latch portions 322 may have other shapes, and there can be more than two holding members 323 and latch portions 322.

It is to be further understood that even though numerous characteristics and advantages have been set forth in the foregoing description of embodiments, together with details of the structures and functions of the embodiments, the disclosure is illustrative only; and that changes may be made in detail, especially in matters of shape, size, and arrangement of parts within the principles of the disclosure to the full extent indicated by the broad general meaning of the terms in which the appended claims are expressed.

What is claimed is:

1. An illuminating apparatus comprising:

a light source comprising a substrate and at least one light emitting diode arranged on the substrate;

a supporting member connected to the substrate, the supporting member comprising a light emitting surface at a side thereof distant from the at least one light emitting diode;

a first film and a second film attached to each other and arranged at the light emitting surface of the supporting member, the first film comprising a first phosphor doped therein, the second film comprising a second phosphor doped therein, each of the first phosphor and the second phosphor capable of being excited by light emitted from the at least one light-emitting diode and converting a wavelength of the light into a desired wavelength;

wherein the first film further comprises a third phosphor, the first film defines a plurality of first regions arranged in an array, the first phosphor is doped into every odd-numbered first region in a sequence of the first regions, and the third phosphor is doped into every even-numbered first region in the sequence of the first regions;

wherein the second film further comprises a fourth phosphor, the second film defines a plurality of second regions arranged in an array, the second phosphor is doped into every odd-numbered second region in a sequence of the second regions, and the fourth phosphor is doped into every even-numbered second region in the sequence of the second regions; and wherein the first regions of the first film are respectively directly opposite to the second regions of the second film.

2. The illuminating apparatus of claim 1, wherein the supporting member has a generally U-shaped cross section, and the supporting member is arranged under the substrate with a top end thereof contacting a periphery of an underside of the substrate.

3. The illuminating apparatus of claim 1, wherein at least a main central portion of the supporting member comprises an optical lens, and the optical lens is generally plate-shaped and parallel to the substrate.

4. The illuminating apparatus of claim 3, further comprising at least two screws, wherein the substrate comprises at least two first holes, the supporting member comprises at least two second holes, and the optical lens is locked in position by threaded engagement of the at least two screws in the at least two first holes and the at least two second holes.

5. The illuminating apparatus of claim 3, further comprising at least two latch portions, wherein the at least two latch portions are hitched onto peripheral portions of the substrate and an outmost one of the first and second films thereby securing the optical lens in position.

6. The illuminating apparatus of claim 5, wherein a cross-section of each of the latch portions is generally U-shaped.

7. The illuminating apparatus of claim 5, further comprising at least two holding members, wherein the at least two holding members are arranged on the periphery of an inner side of the substrate and are configured for holding the optical lens in position a predetermined distance away from the light source.

8. The illuminating apparatus of claim 1, wherein the at least one light emitting diode is at least one ultraviolet light emitting diode.

9. The illuminating apparatus of claim 1, wherein each of the first film and the second film is made of material selected from the group consisting of silicone, polymethyl methacrylate, resin, plastic, polyethylene terephthalate, and polycarbonate.

10. An illuminating apparatus comprising:

a light source comprising a substrate and at least one light emitting diode arranged on the substrate;

a supporting member connected to the substrate, the supporting member comprising a light emitting surface at a side thereof distant from the at least one light emitting diode;

a first film and a second film attached to each other and arranged at the light emitting surface of the supporting member, the first film comprising a first phosphor and a third phosphor doped therein, the first film defining a plurality of first regions arranged in an array, the first phosphor being doped into every odd-numbered first region in a sequence of the first regions, and the third phosphor being doped into every even-numbered first region in the sequence of the first regions, the second film comprising a second phosphor and a fourth phosphor doped therein, the second film defining a plurality of second regions arranged in an array, the second phosphor being doped into every odd-numbered second region in a sequence of the second regions, and the fourth phosphor being doped into every even-numbered second region in the sequence of the second regions, the first regions of the first film being staggered relative to the second regions of the second film, each of the first phosphor and the second phosphor capable of being excited by light emitted from the at least one light-emitting diode and converting a wavelength of the light into a desired wavelength.

11. The illuminating apparatus of claim 10, wherein the supporting member has a generally U-shaped cross section, and the supporting member is arranged under the substrate with a top end thereof contacting a periphery of an underside of the substrate, the at least one light emitting diode being fixed on the underside of the substrate and facing the supporting member.

12. The illuminating apparatus of claim 10, wherein at least a main central portion of the supporting member comprises an optical lens, and the optical lens is generally plate-shaped and parallel to the substrate.

13. The illuminating apparatus of claim 12, further comprising at least two screws, wherein the substrate comprises at least two first holes, the supporting member comprises at least two second holes, and the optical lens is locked in position by threaded engagement of the at least two screws in the at least two first holes and the at least two second holes.

14. The illuminating apparatus of claim 12, further comprising at least two latch portions, wherein the at least two latch portions are hitched onto peripheral portions of the substrate and an outmost one of the first and second films thereby securing the optical lens in position.

15. The illuminating apparatus of claim 14, wherein a cross-section of each of the latch portions is generally U-shaped.

16. The illuminating apparatus of claim 14, further comprising at least two holding members, wherein the at least two holding members are arranged on the periphery of an inner side of the substrate and are configured for holding the optical lens in position a predetermined distance away from the light source.

17. The illuminating apparatus of claim 10, wherein the at least one light emitting diode is at least one ultraviolet light emitting diode.

18. The illuminating apparatus of claim 10, wherein each of the first film and the second film is made of material selected from the group consisting of silicone, polymethyl methacrylate, resin, plastic, polyethylene terephthalate, and polycarbonate.

* * * * *